US007114734B1

(12) United States Patent
Jeal

(10) Patent No.: US 7,114,734 B1
(45) Date of Patent: Oct. 3, 2006

(54) NOVELTY RIDING TOY FOR CHILDREN

(76) Inventor: Gavin Jeal, 3 Ashby's Close, Edenbridge, Kent (GB) Tn85ET ( * ) Notice: Subject to any disclaimer, the term of this patent is extended or adjusted under 35 U.S.C. 154(b) by 234 days.

(21) Appl. No.: 10/808,711

(22) Filed: Mar. 25, 2004

(51) Int. Cl.
*B62B 7/00* (2006.01)

(52) U.S. Cl. ..... 280/87.051; 280/87.021

(58) Field of Classification Search ..... 280/87.05, 280/87.021, 87.051, 827, 828, 470, 471; 446/470, 471; D21/419–435
See application file for complete search history.

(56) References Cited

U.S. PATENT DOCUMENTS

| | | | | | |
|---|---|---|---|---|---|
| 75,274 | A | * | 3/1868 | Hurd | 280/87.051 |
| 765,875 | A | * | 7/1904 | Blake | 280/87.051 |
| 1,313,330 | A | * | 8/1919 | Pocock | 297/137 |
| D142,299 | S | * | 8/1945 | Fletcher | D12/130 |
| 2,988,370 | A | * | 6/1961 | Bertram | 280/87.021 |
| 2,998,979 | A | * | 9/1961 | Sandell | 280/87.05 |
| 3,109,667 | A | * | 11/1963 | Wolner | 280/87.021 |
| D200,789 | S | * | 4/1965 | Davey | D21/430 |
| D202,252 | S | * | 9/1965 | Hubel | D12/586 |
| 3,492,017 | A | * | 1/1970 | Czichos | 280/87.021 |
| 3,515,404 | A | * | 6/1970 | Perego | 280/87.051 |
| 3,874,690 | A | * | 4/1975 | Marrone | 280/47.39 |
| 4,015,853 | A | * | 4/1977 | Summers | 280/87.051 |
| 4,140,311 | A | * | 2/1979 | Murakami | 280/87.05 |
| 4,171,132 | A | * | 10/1979 | Kassai | 280/87.05 |
| D254,743 | S | * | 4/1980 | Petrisco | D21/427 |
| 4,699,392 | A | * | 10/1987 | Ku | 280/87.051 |
| 5,106,150 | A | * | 4/1992 | Litwicki | 296/216.02 |
| 5,154,658 | A | * | 10/1992 | Marcus | 446/411 |
| 5,813,948 | A | * | 9/1998 | Quigg et al. | 482/67 |
| D400,129 | S | * | 10/1998 | Udelhoven | D12/130 |
| 5,921,567 | A | * | 7/1999 | Brown | 280/87.051 |
| 5,997,016 | A | * | 12/1999 | Kaechele | 280/87.021 |
| D452,715 | S | * | 1/2002 | Jang | D21/419 |
| 6,446,981 | B1 | * | 9/2002 | Wise et al. | 280/7.17 |

* cited by examiner

*Primary Examiner*—J. Allen Shriver

(57) ABSTRACT

A child toy includes a substantially annular base section that has a planar top surface and an outer edge portion integral therewith. The base section includes a plurality of spaced support members extending upwardly from the top surface and further has an inner perimeter spaced inwardly from the outer edge portion. The base section further includes a seat and a foot plate for supporting a foot of a user at an elevated position above ground level. The present invention further includes a substantially annular top section connected to the plurality of support members, and is spaced at a predetermined height from the base section for allowing a child to enter and exit the toy. The toy also includes a plurality of casters connected to the base section and extending downwardly therefrom.

13 Claims, 3 Drawing Sheets

NOVELTY RIDING TOY FOR CHILDREN

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a riding toy and, more particularly, to a novelty riding toy for children with educational and entertaining purposes.

2. Prior Art

Numerous examples of toy vehicles, such as automobiles, trucks, ambulances, racing cars and the like can be found in the art. The primary purpose of these toys is to provide means for children to entertain themselves. Some of these toy vehicles are designed to be ridden by the children. They can be propelled by pushing the toy or by pushing pedals which in turn drive the toy. These toys which a child pushes by placing his or her feet on the ground while sitting on the toy and pushing with his or her legs can be dangerous because other children may push the toy while the rider's feet are on the ground, causing the rider's feet to be caught under the toy and injured. These riding toys do not have any means to prevent children from being injured in this manner.

Toy vehicles generally are not designed to serve an educational purpose, even though there is an increasing focus on this function. For example, some dolls are designed to teach infants how to dress themselves and some electronic toys are designed to teach children to associate animals with the sounds they make or to learn addition or spelling.

Toy vehicles found in the prior art, however, are only intended to amuse children, and not to teach them. However, it has been found that children often tend to quickly lose interest in walker toys of this type and that as a result, they often prefer to crawl rather than working toward the development of early walking skills. Although toy vehicles exercise children's imaginations and sometimes their bodies, they do not attempt to teach children in the same sense as "educational" toys.

Accordingly, a need remains for a novelty riding toy for children, which overcomes the above-noted shortcomings.

BRIEF SUMMARY OF THE INVENTION

In view of the foregoing background, it is therefore an object of the present invention to provide for a novelty riding toy for children that is entertaining and educational. These and other objects, features, and advantages of the invention are provided by a child's toy including a substantially annular base section that has a centrally disposed axis traversing therethrough. The base section further has a substantially planar top surface and an outer edge portion integral therewith, that extends downwardly from the top surface and is disposed substantially perpendicular thereto.

A plurality of spaced support members extend upwardly from the top surface and converge inwardly towards the axis.

The base section further has an inner perimeter spaced inwardly from the outer edge portion wherein a seat and foot plate are connected thereto. The foot plate is diametrically opposed from the seat and for advantageously supporting a foot of a user at an elevated position above ground level. The toy may further include a dashboard including a steering column connected thereto. The dashboard is preferably disposed within the inner perimeter of the base section and adjacent the foot plate. The toy preferably further includes a plurality of storage compartments formed within the base section, for advantageously maintaining selected objects therein.

The present invention further includes a substantially annular top section connected to the plurality of support members and centered about the axis. The top section is spaced at a predetermined height from the base section for conveniently allowing a child to enter and exit the toy. The top section further includes a substantially planar bottom surface provided with indicia thereon for advantageously displaying the solar system, for example.

Of course, such a bottom surface may display alternate educational images suitable for a child's learning experience. The bottom surface is conveniently viewable by a child during operating conditions. The toy may further include a plurality of illuminable members disposed on the top surface and radially offset from the axis, for emitting light in a substantially vertical direction and towards the top section.

The toy also includes a plurality of casters connected to the base section and extending downwardly therefrom. The plurality of casters are offset substantially medially between the outer edge portion and the inner perimeter respectively. The plurality of casters are preferably pivotally connected to the base section for advantageously allowing a user to guide the toy in linear and radial directions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
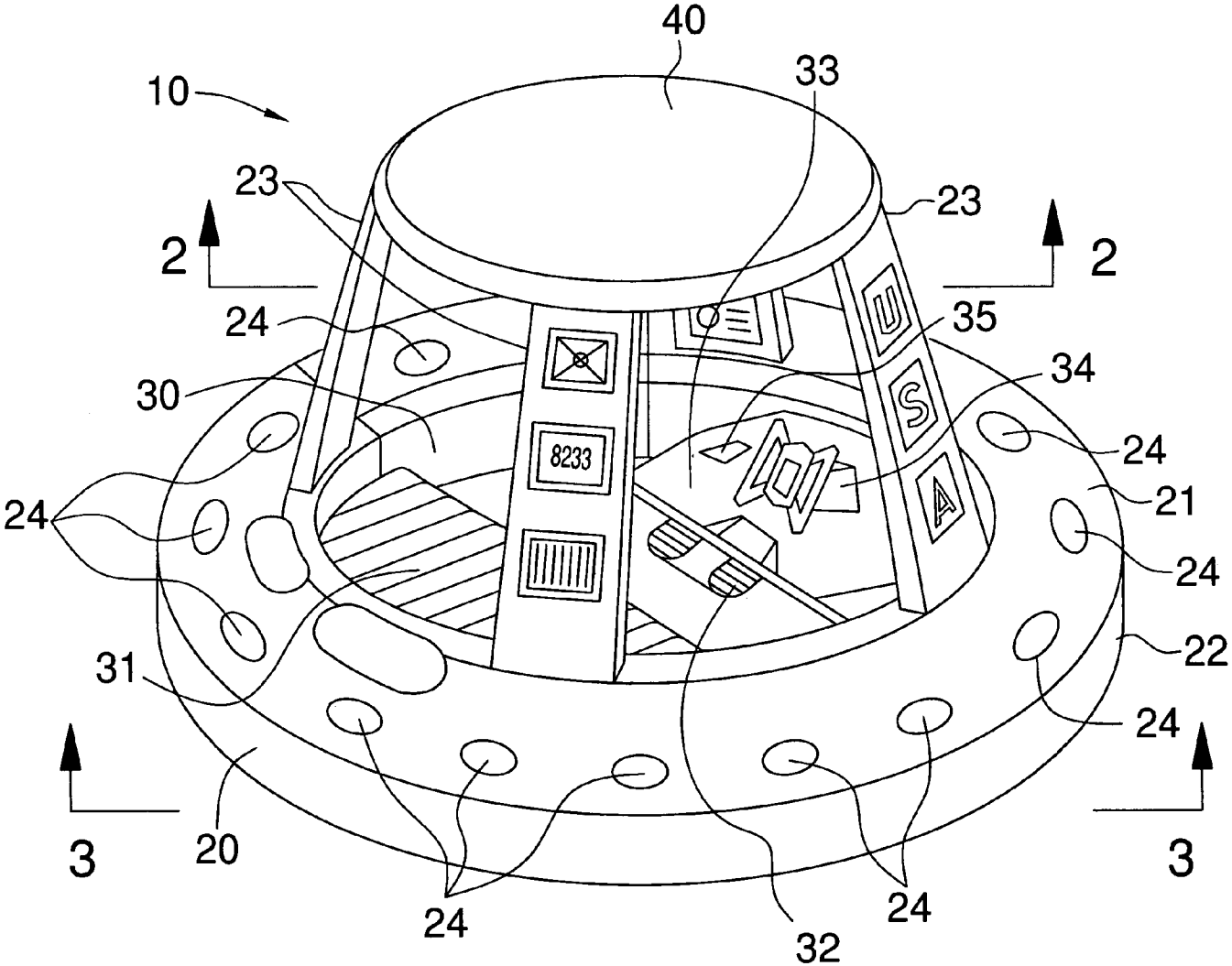
FIG. 1 is a perspective view showing a novelty riding toy for children, in accordance with the present invention.
Figure 2:
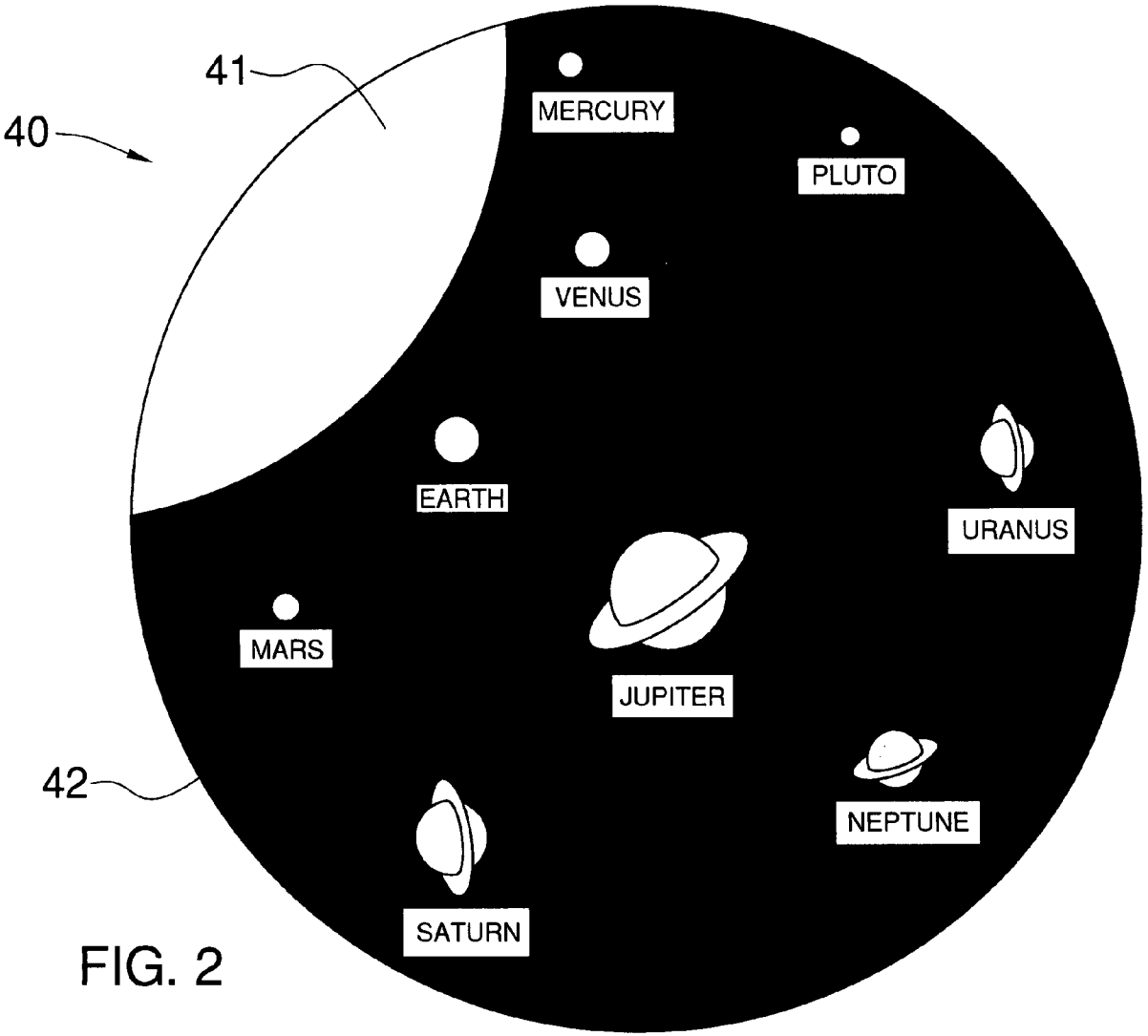
FIG. 2 is a bottom-plan view of the top section shown in FIG. 1.
Figure 3:
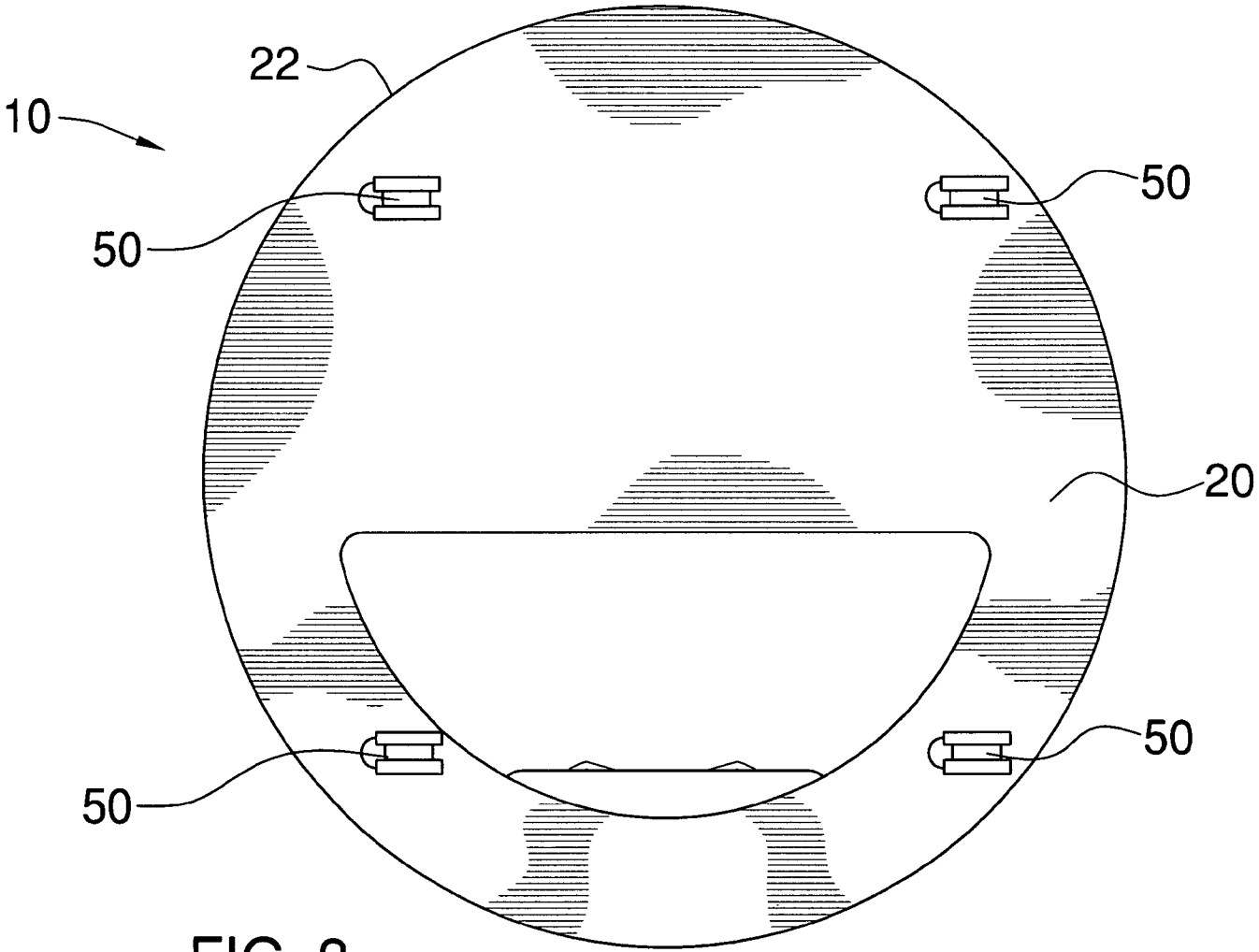
FIG. 3 is a bottom-plan view of the toy shown in FIG. 1.

The device of this invention is referred to generally in FIGS. 1–3 by the reference numeral 10 and is intended to provide a novelty riding toy for children with entertaining and educational purposes. It should be understood that the device 10 may be used to embody many different types of space crafts and should not be limited to only an annular shape.

Referring initially to FIG. 1, the device 10 includes a substantially annular base section 20 that has a centrally disposed axis traversing therethrough. The base section 20 further has a substantially planar top surface 21 and an outer edge portion 22 integral therewith, that extends downwardly from the top surface 21 and is disposed substantially perpendicular thereto. A plurality of spaced support members 23 extend upwardly from the top surface 21 and converge inwardly towards the axis.

The base section 20 further has an inner perimeter 30 spaced inwardly from the outer edge portion 22 wherein a seat 31 and foot plate 32 are connected thereto. The foot plate 32 is diametrically opposed from the seat 31 and for advantageously supporting a foot of a user at an elevated position above ground level. The toy 10 may further include a dashboard 33 including a steering column 34 connected thereto. The usage of the foot plate 32 and the steering column 34 will advantageously improve the motor skills of all young children. The dashboard 33 is preferably disposed within the inner perimeter 30 of the base section 20 and adjacent the foot plate 32.

The toy 10 preferably further includes a plurality of storage compartments 35 formed within the base section 20, for advantageously maintaining selected objects therein. These compartments 35 can possibly house educational books rented from a local library that accompany the educational indicia found on the bottom surface 41 of the top section 40, thus enhancing the learning experience.

The present invention further includes a substantially annular top section 40 connected to the plurality of support members 23 and centered about the axis. The top section 40 is spaced at a predetermined height from the base section 20 for conveniently allowing a child to enter and exit the toy 10. The top section 40 further includes a substantially planar bottom surface 41 provided with indicia 42 thereon for advantageously displaying the solar system, for example.

Of course, such a bottom surface 41 may display alternate educational images suitable for a child's learning experience. These images may include different cloud formations or indicia showing various star constellations. The bottom surface 41 is conveniently viewable by a child during operating conditions. The toy 10 may further include a plurality of illuminable members 24 disposed on the top surface 21 and radially offset from the axis, for emitting light in a substantially vertical direction and towards the top section 40.

The toy 10 also includes a plurality of casters 50 connected to the base section 20 and extending downwardly therefrom. The plurality of casters 50 are offset substantially medially between the outer edge portion 22 and the inner perimeter 30 respectively. The plurality of casters 50 are preferably pivotally connected to the base section 20 for advantageously allowing a user to guide the toy 10 in linear and radial directions. The casters 50, grants the toy 10 the appearance of gliding, as if traveling through space which will increase its appeal to young children.

The appealing features of the toy 10 are its entertainment value, exercise value, and ability to help a child use his or her imagination through playing make-believe games. The design of the unit is more original than standard riding toys, thus providing a toy the child will be more proud to show off to his or her friends. The low frame mount of the toy 10 will provide balance and reduce the chances of falling, thereby increasing the safety of the toy 10. The entertainment and education value of this toy 10 will be appreciated by both parents and individuals owning day care centers who wish to provide the latest educational toys to their children.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A child's toy comprising:

a substantially annular base section having a centrally disposed axis traversing therethrough, said base section further having a substantially planar top surface and an outer edge portion integral therewith, said outer edge portion extending downwardly from said top surface and being disposed substantially perpendicular thereto, said base section including a plurality of spaced support members extending upwardly from said top surface and converging inwardly towards the axis, said base section further having an inner perimeter spaced inwardly from said outer edge portion, said base section further including a seat connected to the inner perimeter and a foot plate connected to the inner perimeter, said foot plate being diametrically opposed from said seat and for supporting a foot of a user at an elevated position above ground level;

a substantially annular top section connected to said plurality of support members and centered about the axis, said top section being spaced at a predetermined height from said base section for allowing a child to enter and exit said toy;

a plurality of casters connected to said base section and extending downwardly therefrom, said plurality of casters being offset substantially medially between said outer edge portion and the inner perimeter respectively; and a plurality of illuminable members disposed on said top surface and radially offset from the axis, said plurality of illuminable members for emitting light in a substantially vertical direction and towards said top section.

2. The toy of claim 1, further comprising:

a plurality of storage compartments formed within said base section and for maintaining selected objects therein.

3. The toy of claim 1, further comprising:

a dashboard including a steering column connected thereto, said dashboard being disposed within the inner perimeter of said base section and adjacent said foot plate.

4. The toy of claim 1, wherein said top section further includes a substantially planar bottom surface provided with indicia thereon for displaying the solar system, said bottom surface being viewable by a user during operating conditions.

5. The toy of claim 1, wherein said plurality of casters are pivotally connected to said base section for allowing a user to guide said toy in linear and radial directions.

6. A child's toy comprising:

a substantially annular base section having a centrally disposed axis traversing therethrough, said base section further having a substantially planar top surface and an outer edge portion integral therewith, said outer edge portion extending downwardly from said top surface and being disposed substantially perpendicular thereto, said base section including a plurality of spaced support members extending upwardly from said top surface and converging inwardly towards the axis, said base section further having an inner perimeter spaced inwardly from said outer edge portion, said base section further including a seat connected to the inner perimeter and a foot plate connected to the inner perimeter, said foot plate being diametrically opposed from said seat and for supporting a foot of a user at an elevated position above ground level;

a substantially annular top section connected to said plurality of support members and centered about the axis, said top section being spaced at a predetermined height from said base section for allowing a child to enter and exit said toy; and a plurality of casters connected to said base section and extending downwardly therefrom, said plurality of casters being offset substantially medially between said outer edge portion and the inner perimeter respectively, said plurality of casters being pivotally connected to said base section for allowing a user to guide said toy in linear and radial directions; and a plurality of illuminable members disposed on said top surface and radially offset from the axis, said plurality of illuminable members for emitting light in a substantially vertical direction and towards said too section.

7. The toy of claim 6, further comprising:

a plurality of storage compartments formed within said base section and for maintaining selected objects therein.

8. The toy of claim 6, further comprising:

a dashboard including a steering column connected thereto, said dashboard being disposed within the inner perimeter of said base section and adjacent said foot plate.

9. The toy of claim 6, wherein said top section further includes a substantially planar bottom surface provided with indicia thereon for displaying the solar system, said bottom surface being viewable by a user during operating conditions.

10. A child's toy comprising:

a substantially annular base section having a centrally disposed axis traversing therethrough, said base section further having a substantially planar top surface and an outer edge portion integral therewith, said outer edge portion extending downwardly from said top surface and being disposed substantially perpendicular thereto, said base section including a plurality of spaced support members extending upwardly from said top surface and converging inwardly towards the axis, said base section further having an inner perimeter spaced inwardly from said outer edge portion, said base section further including a seat connected to the inner perimeter and a foot plate connected to the inner perimeter, said foot plate being diametrically opposed from said seat and for supporting a foot of a user at an elevated position above ground level;

a substantially annular top section connected to said plurality of support members and centered about the axis, said top section being spaced at a predetermined height from said base section for allowing a child to enter and exit said toy;

a plurality of casters connected to said base section and extending downwardly therefrom, said plurality of casters being offset substantially medially between said outer edge portion and the inner perimeter respectively, said plurality of casters being pivotally connected to said base section for allowing a user to guide said toy in linear and radial directions; and a plurality of illuminable members disposed on said top surface and radially offset from the axis, said plurality of illuminable members for emitting light in a substantially vertical direction and towards said top section.

11. The toy of claim 10, further comprising:

a plurality of storage compartments formed within said base section and for maintaining selected objects therein.

12. The toy of claim 10, further comprising:

a dashboard including a steering column connected thereto, said dashboard being disposed within the inner perimeter of said base section and adjacent said foot plate.

13. The toy of claim 10, wherein said top section further includes a substantially planar bottom surface provided with indicia thereon for displaying the solar system, said bottom surface being viewable by a user during operating conditions.

* * * * *